US008348226B2

(12) United States Patent
Hanson

(10) Patent No.: US 8,348,226 B2
(45) Date of Patent: Jan. 8, 2013

(54) BRACKET ASSEMBLY FOR FACILITATION THE INSTALLATION OF A CONCRETE WALL ON A CONCRETE FOOTING AND A METHOD OF FORMING THE WALL

(76) Inventor: Troy A. Hanson, Weyauwega, WI (US)

( * ) Notice: Subject to any disclaimer, the term of this patent is extended or adjusted under 35 U.S.C. 154(b) by 163 days.

(21) Appl. No.: 12/927,330

(22) Filed: Nov. 10, 2010

(65) Prior Publication Data

US 2011/0088349 A1 Apr. 21, 2011

Related U.S. Application Data

(63) Continuation-in-part of application No. 11/821,304, filed on Jun. 22, 2007, now abandoned.

(51) Int. Cl.
*E04G 11/06* (2006.01)
*E04G 17/00* (2006.01)

(52) U.S. Cl. ..... 249/219.1; 249/34

(58) Field of Classification Search ..... 249/34, 249/33, 205, 207, 213, 216, 219.1, 219.2; 52/293.1, 293.3, 295, 58, 173.1, 745.21; 411/369, 370, 371.1, 542
See application file for complete search history.

(56) References Cited

U.S. PATENT DOCUMENTS

| | | | |
|---|---|---|---|
| 2,153,672 | A | 4/1939 | Mills |
| 2,355,834 | A | 8/1944 | Webb |
| 2,540,622 | A | 2/1951 | Langenberg |
| 2,798,373 | A | 7/1957 | Harza |
| 3,300,173 | A | 1/1967 | Kennedy, Jr. |
| 3,334,455 | A | 8/1967 | Russell |
| 3,385,016 | A | 5/1968 | Crom |
| 3,583,120 | A | 6/1971 | Wangerow |
| 3,778,020 | A | 12/1973 | Burrows et al. |
| 4,029,288 | A | 6/1977 | Murphy et al. |
| 4,669,169 | A | 6/1987 | Hogg |
| 4,712,157 | A | 12/1987 | Simonson et al. |
| 4,736,923 | A | 4/1988 | Losada |
| 5,125,616 | A | 6/1992 | Rothenbuehler et al. |
| 5,171,107 | A | 12/1992 | Hamilton et al. |
| 5,178,503 | A | 1/1993 | Losada |
| 5,234,287 | A | 8/1993 | Rippe, Jr. |
| 5,489,468 | A | 2/1996 | Davidson |
| 5,634,756 | A | 6/1997 | Losada |
| 5,897,082 | A | 4/1999 | Losada |
| 5,979,123 | A | 11/1999 | Brockman |
| 6,418,684 | B1 | 7/2002 | Morton |
| 6,591,574 | B2 | 7/2003 | Humphrey |
| 6,705,582 | B2 | 3/2004 | Osborn |
| 7,062,885 | B1 | 6/2006 | Dickenson, Jr. |
| 2004/0040236 | A1 | 3/2004 | Adams |
| 2006/0096204 | A1 | 5/2006 | Martens et al. |
| 2006/0260232 | A1 | 11/2006 | Crawford et al. |

*Primary Examiner* — Janet M Wilkens
*Assistant Examiner* — Timothy M Ayres
(74) *Attorney, Agent, or Firm* — Thomas J. Connelly; Wilhelm Law, S.C.

(57) ABSTRACT

A bracket assembly is disclosed for facilitating the installation of a concrete wall on a concrete footing, as well as a method of forming the concrete wall. The bracket assembly includes a base member having an upper surface and a lower surface, and first and second upwardly extending flanges. A first aperture is formed through the base member and a sealant is positioned in the cavity. A retainer and shock absorber assembly is secured to the upper surface and an aperture is formed therethrough which is coaxially aligned with the first aperture. A fastener having a shank with a pointed end is inserted through the aperture such that the pointed end is initially encased in the sealant. The fastener is inseparable from the bracket assembly and is capable of being driven into the concrete footing.

18 Claims, 7 Drawing Sheets

A method of facilitating installation of a concrete wall on a concrete footing, said method comprising the steps of:

marking a pair of spaced apart lines on an upper surface of said concrete footing;

positioning at least two bracket assemblies between said pair of spaced apart lines at a predetermined distance, each of said bracket assemblies including a base member having a first end, a second end, a first side edge, a second side edge, an upper surface and a lower surface, a first flange integrally formed with said base member and extending upwardly from said first end, and a second flange integrally formed with said base member and extending upwardly from said second end, a cavity formed in said lower surface of said base member, a first aperture formed through said base member and into said cavity, a sealant is positioned in said cavity, a retainer and shock absorber assembly secured to said base member and having an aperture formed therethrough which is coaxially aligned with said first aperture, and a fastener including a shank having a pointed end and an opposite end containing an enlarged head, said shank extending through said aperture formed in said retainer and shock absorber assembly and into said first aperture, and said fastener being inseparable from said retainer and shock absorber assembly;

securing each of said bracket assemblies to said concrete footing by driving said fastener through said sealant and into said concrete footing;

positioning an interior and an exterior wall form adjacent to said first and second flanges; and pouring concrete between said interior and exterior wall forms to create a concrete wall.

Fig. 17

BRACKET ASSEMBLY FOR FACILITATION THE INSTALLATION OF A CONCRETE WALL ON A CONCRETE FOOTING AND A METHOD OF FORMING THE WALL

CROSS-REFERENCE TO RELATED APPLICATION

This application is a Continuation-In-Part application which claims priority under 23 U.S.C. §120 to application Ser. No. 11/821,304, filed Jun. 22, 2007.

FIELD OF THE INVENTION

This invention relates to a bracket assembly for facilitating the installation of a concrete wall on a concrete footing and a method of forming the wall. More specifically, this invention relates to a bracket assembly that can be used to position forms on a concrete footing for forming a concrete wall and the bracket assembly has a seal which will prevent moisture and/or water from seeping between the concrete wall and the concrete footing.

BACKGROUND OF THE INVENTION

In constructing a building, many foundation walls are formed by pouring concrete between interior and exterior wall forms. Typically, the first order of construction is to dig beneath the nominal surface of the ground, to a depth from which the building will be supported. In a mild climate, e.g. in a southern climate, where no basement is being included in the building, a typical digging depth is about 3 to 4 feet. In a colder climate, e.g. in a northern climate, the minimum depth is typically about 4 feet. Where a basement is being included, the digging depth is approximately 8 to 10 feet.

Once the excavation has been completed, the next order of activity is to form a concrete footing which generally extends about the perimeter of the building. The concrete footing is intended to underlie all other load-bearing portions of the building and can transmit the load of the building to the underlying soil. The dimensions of the concrete footing are about 12 to about 24 inches for a typical single-family home. The width of the footing is typically greater than the width of the upstanding foundation wall which extends upward therefrom. The concrete footing is wider so as to be able to spread the load of the building over a wider foot-print of soil than that which directly underlies the foundation wall. Another advantage of forming a wider concrete footing is that the footings are typically laid out in a more casual fashion than the foundation walls. This means that the footings do not have to exactly conform to the dimensions, angles, widths, etc. shown on the construction drawings.

Typically, after the concrete footing has set or cured for at least two days, one or more workers will have to spend several hours laying out and marking the precise locations where the building foundation walls are to be build on the footing. These locations are typically marked on an upper surface of the concrete footing with chalk, such as a powdered, colored chalked line, known in the trade as a "chalk line". Powdered colored chalk is applied to a chalk line by a special tool. The line is then stretched taut directly over and adjacent to a length of the footing being marked by two construction workers. The taut line is then drawn or stretched slightly away from the footing and is allowed to snap back. The stretch in the chalk line causes the chalk line to "snap" against the footing, applying a line of colored chalk to the cured concrete footing. This process is repeated, as necessary, until the entirety of the perimeter of the concrete footing is marked or chalked, indicating exactly where the foundation walls are to be constructed.

A foundation wall is normally constructed between an interior foundation wall form and an exterior foundation wall form. The interior and exterior foundation wall forms can consist of one or more panels attached together to provide the required length. The interior and exterior foundation wall forms can be united or secured together at regularly spaced intervals by metal ties which maintain the spacing of the interior and exterior foundation wall forms from each other when the foundation wall forms are erected in place on the concrete footing.

The interior and exterior foundation wall forms can be erected separately and be held in place by temporary supports while the metal ties are being inserted and fixed in place. Alternatively, the metal ties can be attached before the interior and exterior foundation wall forms are placed on the concrete footing, whereby the interior and exterior wall forms are placed on the concrete footing as a single pre-assembled unit. Also, it is known to attach ties at the tops of the interior and exterior foundation wall forms to maintain a desired spacing therebetween.

One problem with such conventional foundation wall construction is that the only thing holding the foundation wall forms on the concrete footing is gravity. Accordingly, any substantial lateral force applied at the base of the interior and/or exterior foundation wall forms can move the wall forms laterally relative the concrete footing. On a typical 10 to 40 foot length of wall form, the force of a worker accidentally kicking the wall form adjacent to the concrete footing can move the wall form by one or more inches, sometimes up to 3 to 4 inches. If concrete is then poured between the interior and exterior wall forms with the wall forms being misaligned, the resulting concrete foundation wall will not be straight. In addition, misalignments at the base of the foundation wall can typically be magnified, and in opposing direction, at the top of the foundation wall. The overall result is that the upright wall of the building is formed crooked, typically crooked longitudinally and off-specification with respect to its, typically vertical, upright angle. Such a crooked foundation wall can result in all variety of compromises having to be made in that portion of the building which is supported by the misaligned foundation wall.

A second problem encountered when the chalking system is used to mark the locations for the interior and exterior foundation wall forms is that rain or inclement weather can readily erase the chalk lines. The chalk lines are usually made the day before the interior and exterior foundation wall forms are set into place. If a rain shower occurs in the meantime, it will be necessary for the construction people to again rechalk the positioning lines, thus doubling the work.

Now a bracket assembly and method of using such bracket assemblies has been invented to solve the above-identified problems.

SUMMARY OF THE INVENTION

Briefly, this invention relates to a bracket assembly for facilitating the installation of a concrete wall on a concrete footing. The bracket assembly includes a base member having an upper surface and a lower surface, and first and second upwardly extending flanges. A cavity is formed in the lower surface of the base member. A first aperture is formed through the base member and into the cavity and a sealant is positioned in the cavity. A retainer and shock absorber assembly is secured to the upper surface and an aperture is formed therethrough which is coaxially aligned with the first aperture. A fastener having a shank with a pointed end is inserted through the aperture such that the pointed end is initially encased in the sealant. The fastener is inseparable from the bracket assembly and is capable of being driven into the concrete footing.

In another embodiment, the bracket assembly includes a base member, a first end, a second end, an upper surface, a lower surface, and first and second flanges extending upward from the first and second ends, respectively. The first and second flanges are integrally formed with the base member. The bracket assembly also includes a pair of channels formed in the lower surface of the base member. A pair of first apertures is formed through the base member and each of the pair of first apertures is aligned with one of the pair of channels. A sealant is positioned in each of the pair of channels and extends across the width of the lower surface of the bracket assembly. The bracket assembly further includes a pair of retainer and shock absorber assemblies each secured to the upper surface and each having an aperture formed therethrough which is coaxially aligned with one of the first apertures. A fastener having a shank with a pointed end is inserted through each of the apertures such that the pointed end is initially encased in the sealant. Each of the fasteners is inseparable from the bracket assembly and is capable of being driven into the concrete footing.

This invention also relates to a method of facilitating the installation of a concrete wall on a concrete footing. The method includes the steps of marking a pair of spaced apart lines on an upper surface of a concrete footing. Two or more bracket assemblies are then positioned between the pair of spaced apart lines at predetermined distances. Each of the bracket assemblies includes a base member having an upper surface and a lower surface, and first and second upwardly extending flanges. A cavity is formed in the lower surface of the base member. A first aperture is formed through the base member and into the cavity and a sealant is positioned in the cavity. A retainer and shock absorber assembly is secured to the upper surface and an aperture is formed therethrough which is coaxially aligned with the first aperture. A fastener having a shank with a pointed end is inserted through the aperture such that the pointed end is initially encased in the sealant. The fastener is inseparable from the bracket assembly and is capable of being driven into the concrete footing. As the bracket assembly is secure to the concrete footing, the sealant forms a watertight seal under the bracket and adjacent to the concrete footing. Interior and exterior foundation wall forms are then positioned on either side of the bracket assemblies and concrete is poured therebetween to create a concrete foundation wall.

The general object of this invention is to provide a bracket assembly for facilitating installation of a concrete wall on a concrete footing. A more specific object of this invention is to provide a method of facilitating installation of a concrete wall on a concrete footing.

Another object of this invention is to provide inexpensive bracket assemblies that can be easily and quickly secured to an upper surface of a concrete footing so as to align interior and exterior foundation wall forms into which concrete can be poured to form a concrete foundation wall on top of a concrete footing.

A further object of this invention is to provide bracket assemblies that are permanently secured between a concrete footing and an upstanding concrete foundation wall and which form a watertight seal between a lower surface of the bracket and the upper surface of the concrete footing.

Still another object of this invention is to provide bracket assemblies that are inexpensive to manufacture and are easy to use to ensure that a concrete foundation wall which is to be poured onto a concrete footing is correctly positioned.

Still further, an object of this invention is to provide a unitary bracket assembly that will reduce the time it takes to correctly position interior and exterior wall forms on a concrete footing.

Other objects and advantages of the present invention will become more apparent to those skilled in the art in view of the following description and the accompanying drawings.

BRIEF DESCRIPTION OF THE DRAWINGS

FIG. 17 is a flow diagram of a method of facilitating the installation of a concrete wall on a concrete footing.

Figure 1:
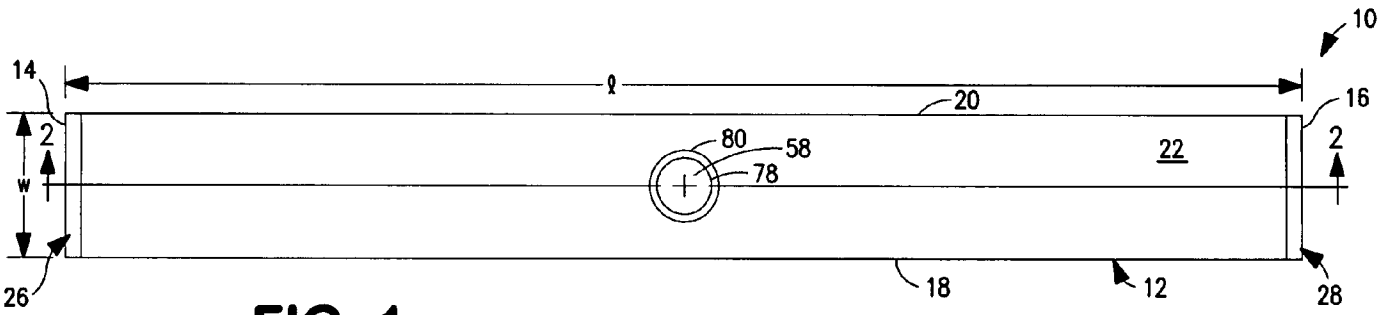
FIG. 1 is a top view of a bracket assembly.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE INVENTION

Figure 2:
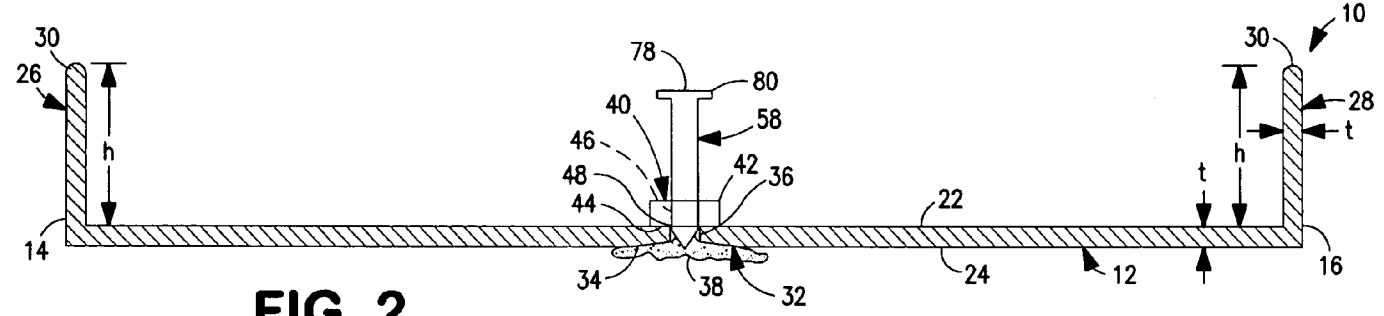
FIG. 2 is a cross-sectional view of the bracket assembly shown in FIG. 1 taken along line 2-2.
Figure 3:
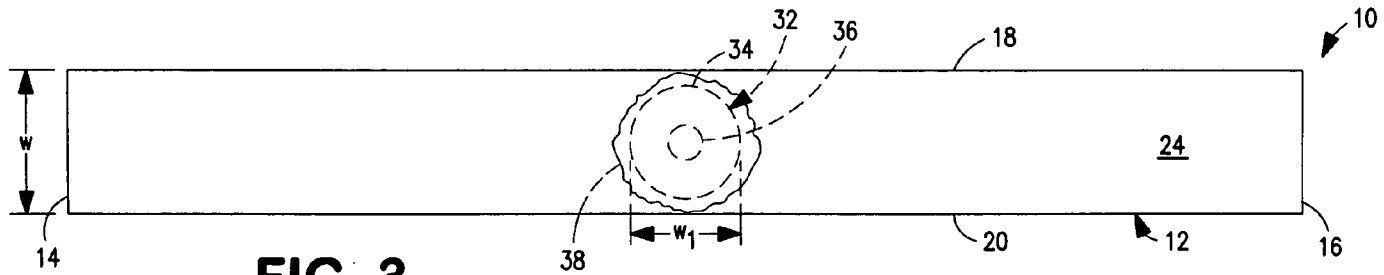
FIG. 3 is a bottom view of the bracket assembly shown in FIG. 1 depicting the sealant positioned within the cavity formed in the lower planar surface of the base member.

Referring to FIGS. 1-3, a bracket assembly 10 is shown for facilitating installation of a concrete wall on a concrete footing. The bracket assembly 10 includes a base member 12 having a first end 14, a second end 16, a first side edge 18 a second side edge 20, an upper surface 22 and a lower surface 24. Each of the upper and lower surfaces, 22 and 24 respectively, can be planar and/or smooth in appearance or either can have an irregular appearance. Desirably, the lower surface is planar. The base member 12 can be formed from almost any material, including but not limited to: aluminum, tin, zinc, plastic, a thermoplastic such as polyethylene or polypropylene, a composite material formed from two or more different materials, an alloy, a metal alloy, or from any other material known to those skilled in the art. Desirably, the base member 12 is formed from a non-ferrous material or a non-metallic material so that it will not rust. By "nonferrous" it is meant a material that is not composed of or contains iron. By "non-metallic" it is meant a material that is not metallic or being a nonmetal. More desirably, the base member 12 will be constructed from a thermoplastic material since it is inexpensive compared to an alloy or composite material. A thermoplastic material can be formed by any known process, including but not limited to: injection molding, extrusion, etc. Even more desirably, the base member 12 is constructed of a waterproof and rust-proof plastic.

Referring to FIGS. 1 and 2, the bracket assembly 10 has a length l, a width w and a thickness t. The length l, width w and the thickness t of the bracket assembly 10 can vary depending upon the material from which it is constructed and the process used to form the bracket assembly 10. The length l can be any desired length but normally will correspond to the standard width at which concrete foundation walls are poured so as to meet city, town, county, state and/or federal building codes. For a residential house, the concrete foundation walls are normally 6 or 8 inches in thickness. For commercial buildings, the concrete foundation walls are typically 8, 10 or 12 inches in thickness. However, depending upon the load of the building, the concrete mix and the presence of any reinforcement members or chemicals used in the concrete, the width of the concrete foundation wall can vary from 4 inches up to about 2 feet. Some government installations can actually use concrete foundation walls that are greater than 2 feet in width.

It should also be recognized that new materials, such as sheets of insulation formed from Styrofoam and other materials, are being used in place of the conventional aluminum, steel, metal or wood concrete foundation wall forms. When such insulation sheets are used, they normally stay in place after the concrete cures and therefore the finished width of the concrete foundation wall located between these sheets can result in some odd dimensions. Because of this, the length l of the bracket assembly 10 may have to be constructed at 8.25 inches, 8.5 inches or 8.75 inches versus the standard 8 inches.

The width w of the bracket assembly 10 can range from between about 0.25 inches to about 12 inches. Desirably, the width w of the bracket assembly 10 can range from between about 0.5 inches to about 6 inches. More desirably, the width w of the bracket assembly 10 can range from between about 0.75 inches to about 3 inches. Even more desirably, the width w of the bracket assembly 10 can range from between about 1 inch to about 2 inches. A width w for the bracket assembly 10 of about 1 inch is sufficient for most residential construction of concrete foundation walls.

Referring to FIG. 2, the thickness t of the bracket assembly 10 can be very dependent upon the process used to form the bracket assembly 10, especially when the bracket assembly 10 is formed from a thermoplastic material, such as polyethylene. The thickness t of the bracket assembly 10 can range from about 0.05 inches to about 0.5 inches. Desirably, the thickness t of the bracket assembly 10 will range from about 0.08 inches to about 0.4 inches. More desirably, the thickness t of the bracket assembly 10 will range from about 0.1 inches to about 0.3 inches. Even more desirably, the thickness t of the bracket assembly 10 will range from about 0.12 inches to about 0.2 inches. A thickness t for the bracket assembly 10 of about 0.125 inches is sufficient for most residential construction of concrete foundation walls.

It should be noted that the thickness dimension of the first and second flanges, 26 and 28 respectively, can be the same or different from the thickness of the remainder of the base member 12. Desirably, the entire base member 12 will be manufactured to a single thickness t.

Still referring to FIGS. 1 and 2, the bracket assembly 10 also includes a first flange 26 and a second flange 28. The first and second flanges, 26 and 28 respectively, are spaced apart from one another with the first flange 26 being located adjacent to or abutting the first end 14 and the second flange 28 being located adjacent to or abutting the second end 16. The first and second flanges, 26 and 28 respectively, can be aligned at an angle to the base member 12. Desirably, the first and second flanges, 26 and 28 respectively, are aligned approximately at a right angle or 90 degrees to the base member 12. More desirably, the first and second flanges, 26 and 28 respectively, are aligned at a right angle to the base member 12. In other words, the first and second flanges, 26 and 28 respectively, are aligned perpendicular to the base member 12. The first and second flanges, 26 and 28 respectively, are integrally formed with the base member 12 and extend upwardly therefrom. By "integral" it is meant a unitary or complete unit, essential or necessary for completeness. By forming the base member 12 as an integral unit, one can decrease the cost of manufacturing the base member 12 since the first and second flanges, 26 and 28 respectively, do not have to be adhered, glued, joined, screwed, bolted or somehow mechanically or chemically joined to the base member 12.

Referring to FIG. 2, one can clearly see that the bracket assembly 10 has a C-shaped or U-shaped configuration. However, the bracket assembly 10 can have any desired configuration. Desirably, the first and second flanges, 26 and 28 respectively, will square off the first and second ends, 14 and 16 of the base member 12 and give the bracket assembly 10 the appearance of half of a rectangle. In FIG. 2, one will also see that each of the first and second flanges, 26 and 28 respectively, has a height h. The height h is measured from the upper surface 22 of the base member 12 to a free or terminal end 30 of each of the first and second flanges, 26 and 28 respectively. The height h of the first and second flanges, 26 and 28 respectively, can vary to suit one's particular needs and requirements. However, it has been found that the height h of the first and second flanges, 26 and 28 respectively, should range from between about 0.5 inches to about 3 inches. Desirably, the height h of the first and second flanges, 26 and 28 respectively, should be at least about 0.6 inches, and more desirably at least about 0.75 inches. A height h for the first and second flanges, 26 and 28 respectively, of between about 0.75 inches to about 2 inches works well for most residential construction of concrete foundation walls.

It should be noted that the first and second flanges, 26 and 28 respectively, can be manufactured to the same or different dimensions. Desirably, the height h of each of the first and second flanges, 26 and 28 respectively, will be equal.

Another way of calculating a sufficient height h for the first and second flanges, 26 and 28 respectively, is to adjust the height h of the first and second flanges, 26 and 28 respectively, relative to the length l of the base member 12. Typically, the height h of each of the first and second flanges, 26 and 28 respectively, should range from between at least about 5% to at least about 50% of the length l of the bracket assembly 10. Desirably, the height h of each of the first and second flanges, 26 and 28 respectively, should be at least about 7%, more desirably, at least about 8%, and even more desirably, at least about 10% of the length l of the bracket assembly 10. By using a height h dimension for the first and second flanges, 26 and 28 respectively, within the above ranges, one can be assured that the bracket assembly 10 will work well for its intended purpose.

Referring now to FIGS. 2 and 3, the bracket assembly 10 also has at least one cavity 32 formed in the base member 12. The cavity 32 has an opening 34 aligned with the lower surface 24. The cavity 32 can be almost any desired geometrical shape or configuration. In FIG. 3, the cavity 32 is shown as having a round or circular opening similar to what can be produced by a counter bore or a counter sink. By "counter bore or counter sink" it is meant a hole or opening with the exposed part enlarged adjacent to the lower surface 24. The opening 34 can be sized to be smaller than, equal to or be larger than the dimensions of the cavity 32. Depending upon the configuration of the cavity 32, in some cases the opening 34 is larger than the dimensions of the cavity 32. The opening 34 typically has a circular profile.

In FIG. 3, the cavity 32 is shown having a width $w_1$. The width $w_1$ should extend across at least about 75% of the width w of the base member 12. Desirably, the width $w_1$ should extend across at least about 85% of the width w of the base member 12. More desirably, the width $w_1$ should extend across at least about 95% of the width w of the base member 12. Even more desirably, the width $w_1$ should extend completely across the width w of the base member 12. The reason for this size dimension will be explained shortly.

The cavity 32 can be formed between the upper surface 22 and the lower surface 24 of the base member 12. The upper surface 22 can be formed on a horizontal plane and the cavity 32 can have an uppermost surface which lies above the horizontal plane of the upper surface 22.

Still referring to FIGS. 2 and 3, the bracket assembly 10 further includes a first aperture 36 formed through the base member 12 and which is aligned with the cavity 32. The aperture 36 is shown extending from the upper surface 22 of the base member 12 down into the cavity 32. Desirably, the aperture 36 is coaxially aligned with the circular opening 34. The length of the aperture 36 will partly depend upon the thickness t of the bracket assembly 10.

A sealant 38 is positioned in the cavity 32. Desirably, some of the sealant 38 will extend downward a slight amount below the lower surface 24 of the base member 12. More desirably, some of the sealant 38 will extend across the width w of the base member 12. It is important to have the sealant 38 extend across the width w of the base member 12 so as to form a moisture and/or watertight seal under the bracket assembly 10. The sealant 38 can initially extend below the lower surface 24 of the base member 12 by from between about 0.01 to about 0.25 inches. Since the upper surface of a cured concrete footing can be rather rough or coarse, the extra sealant 38 present below the lower surface 24 of the base member 12 will assure that a good seal is formed when the bracket assembly 10 is secured to the concrete footing.

The sealant 38 can be any material that can be used to form a moisture and/or water barrier on the lower surface 24 of the base member 12 to prevent moisture and/or water from passing from the outside of the foundation wall to the inside of the foundation wall. The sealant 38 should be capable of forming a moisture proof, watertight, waterproof or water repellant seal between the lower surface 24 of the base member 12 and an upper surface of a concrete footing. Various materials known to those skilled in the art can be used for the sealant 38. A number of polymers are readily available that can perform this intended function. One material that works well as the sealant 38 is silicone. Silicone is any of a group of semi-inorganic polymers of siloxane, characterized by high lubricity and therefore stability, extremely water repellent, and physiological inert. Silicone is a water repellant, pliable material that remains receptive to change in physical dimensions during its useful life. Silicone is commercially available from a number of vendors. The sealant 38 can also be foam, insulating foam, expandable foam, a polyurethane or any other material known to those skilled in the art which has moisture and/or water resistance and/or water repellant properties.

The sealant 38 should be pliable so that it can be inserted into the cavity 32 and can extrude outward from the perimeter of the cavity 32 a predetermined amount so as to form a moisture and/or watertight seal across the width w of the lower surface 24 of the base member 12. By "pliable" it is meant that the sealant 38 can be easily shaped, is adaptable, and is receptive to change. As pressure is exerted on the upper surface 22 of the base member 12, the sealant 38 will form a tight seal against the upper surface of the concrete footing.

It should be noted that the sealant 38 does not have to set or acquire a final configuration but instead can be fluid such that it can change shape over its useful life. Silicone has this unique characteristic.

Figure 4:
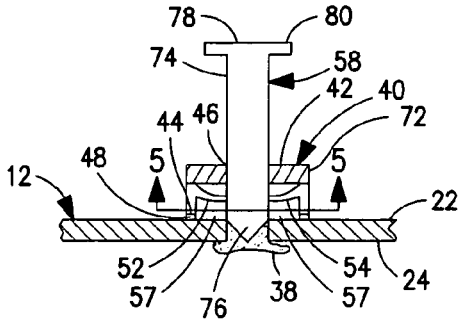
FIG. 4 is a cross-sectional view of a portion of the base member and the retainer and shock absorber assembly secured thereto as depicted in FIG. 2 and shows the fastener inserted through the aperture of the retainer and shock absorber assembly.
Figure 5:
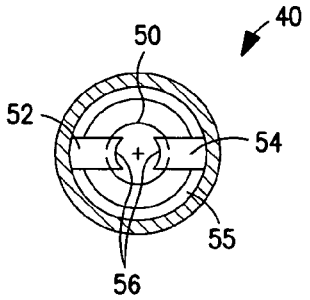
FIG. 5 is a cross sectional view of FIG. 4 taken along line 5-5 depicting the pair of oppositely aligned fingers.

Referring now to FIGS. 2, 4 and 5, the bracket assembly 10 further includes a retainer and shock absorber assembly 40. The retainer and shock absorber assembly 40 has an upper surface 42, a lower surface 44 and an aperture 46 extending therebetween. The lower surface 44 is secured to the upper surface 22 of the base member 12, such as by adhesive 48 or by other securement devices known to those skilled in the art. For example, the lower surface 44 of the retainer and shock absorber assembly 40 can be secured or attached to the upper surface 22 of the base member 12 by a chemical fastener such as: an adhesive, a glue, an epoxy, a resin, or other compounds known to those skilled in the art, or by a mechanical fastener such as: by welding, by using heat and pressure, or other means known to those skilled in the art. Desirably, the lower surface 44 of the retainer and shock absorber assembly 40 is adhered to the upper surface 22 of the base member 12 by an adhesive.

The aperture 46 is coaxially aligned with the first aperture 36 which is formed in the base member 12. Desirably, both the first aperture 36 and the aperture 46 are of the same diameter. Alternatively, the diameter of the aperture 46 can be slightly smaller or larger than the diameter of the first aperture 36. For example, the diameter of the aperture 46 can be slightly smaller than the diameter of the first aperture 36. The coaxially alignment of the aperture 46 with the first aperture 36 establishes a straight bore which extends completely through both the retainer and shock absorber assembly 40 and the base member 12. The aperture 46 formed through the retainer and shock absorber assembly 40 can vary in size and geometrical shape. Desirably, the aperture 46 has a circular cross-section. The aperture 46 has an outer periphery 50, see FIG. 5. The size of the outer periphery 50 can vary but usually is less than about 0.25 inches in diameter. Desirably, the diameter of the aperture 46 is less than about 0.2 inches. More desirably, the diameter of the aperture 46 is less than about 0.15 inches. Even more desirably, the diameter of the aperture 46 is less than about 0.1 inches.

Referring to FIGS. 4 and 5, the retainer and shock absorber assembly 40 also includes a pair of oppositely aligned fingers 52 and 54 secured to and extending inwardly from a base member 55. The base member can have any desired geometrical shape. Desirably, the base member 55 is cylindrical in configuration. Each finger 52 and 54 has a first end 56 which extends within the circumference of the outer periphery 50 of the aperture 46. The first ends 56, 56 are located within the base member 55. A void area 57 is located within the base member 55 and is present below each of the pair of fingers 52 and 54. The void area 57 can occupy the entire area of the base member 55. The void area 57 allows the pair of fingers 52 and 54 to flex downward.

The pair of fingers 52 and 54 are sized and configured to contact and engage a fastener 58 which is inserted into the aperture 46 and passes below the pair of fingers 52 and 54. The pair of fingers 52 and 54 will prevent the fastener 58 from being withdrawn from the retainer and shock absorber assembly 40. Optionally, the fastener 58 may be removed from the retainer and shock absorber assembly 40 only when excessive force is used. When this occurs, the fastener 58 and/or the retainer and shock absorber assembly 40 will most likely be destroyed or deformed beyond the point of being useful for their intended purpose.

Figure 6:
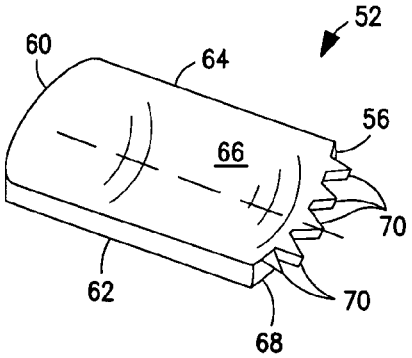
FIG. 6 is an enlarged view of one of the pair of fingers showing a first end containing a plurality of teeth and first and second side edges having a concave configuration therebetween.

Referring to FIG. 6, each of the pair of fingers 52 and 54 has a second end 60 which is aligned opposite to the first end 56. Each of the pair of fingers 52 and 54 also has a first side edge 62, a second side edge 64, an upper surface 66 and a lower surface 68. The upper surface 66 has a non-planar configuration between the first and second side edges, 62 and 64 respectively. Desirably, this non-planar configuration is concave or in the shape of a hollow disc. When each of the upper surfaces 66, 66 of the pair of fingers 52 and 54 is concave, it makes it very difficult for the pair of finger 52 or 54 to flex upward. In other words, the pair of oppositely aligned fingers 52 and 54 will prevent a fastener 58, which is positioned in the aperture 46, from being separated from the retainer and shock absorber assembly 40 because the pair of fingers 52 and 54 will engage with the fastener 58 and hold it firm.

It should be noted that the pair of fingers 52 and 54 will not prevent the fastener 58 from being hammered or driven downwardly into a concrete footing but will prevent the fastener 58 from being separated from the retainer and shock absorber assembly 40.

The first end 56 of each of the pair of fingers 52 and 54 also has a plurality of teeth 70 formed thereon. The teeth 70 can vary in number, size and/or configuration. Each of the plurality of teeth 70 can be sharp and terminate in a point. The oriented of the teeth 70 can be adjusted inward and/or downward as to increase their gripping power as they engage with a fastener 58 passing through the aperture 46. Alternatively, the plurality of teeth 70 can extend horizontally inward toward the center of the aperture 46. The plurality of teeth 70 help ensure that a fastener 58 inserted in the aperture 46 cannot be withdrawn therefrom.

Referring again to FIG. 4, the retainer and shock absorber assembly 40 further includes a shock absorber 72. The shock absorber 72 can be formed from various materials. Desirably, the shock absorber 72 is formed from a compressible material. The shock absorber 72 can be constructed of almost any flexible, malleable, ductile, plastic, pliable, pliant, supple and/or adaptable material which has the ability to readily undergo change or modification without breaking. One material that works well as the shock absorber 72 is rubber. Rubber is an amorphous, elastic, solid polymer of isoprene. Rubber is generally prepared by coagulation and drying of the milky sap or latex of various tropical plants, especially the rubber tree, and subsequently vulcanized, pigmented, and otherwise modified. However, other numerous synthetic elastic materials, synthetic rubber, polymers, etc. of varying chemical composition, with properties similar to those of natural rubber, can also be used. The shock absorber 72 is shown as being positioned above or adjacent to the pair of fingers 52 and 54. However, the shock absorber 72 can be positioned above, below, within or so as surround the pair of fingers 52 and 54. In addition, the pair of fingers 52 and 54 can be partially or be completely enclosed by the shock absorber 72.

The aperture 46 extends through the shock absorber 72 as well as between the first ends 56, 56 of each of the pair of fingers 52 and 54. The aperture 46 is sized and configured to permit a portion of the fastener 58 to pass therethrough. A slight interference fit between the shock absorber 72 and the fastener 58 is beneficial in keeping the fastener 58 attached to the retainer and shock absorber assembly 40. Desirably, the outer periphery 50 of the aperture 46 is smaller than that portion of the fastener 58 which is designed to be inserted therein. The shock absorber 72 can also be constructed such that it only partially surrounds a portion of the fastener 58. In FIG. 4, the shock absorber 72 is depicted as a disc or thick washer situated above the pair of fingers 52 and 54. The shock absorber 72 can also be formed in a variety of other geometrical shapes.

Referring again to FIGS. 1, 2 and 4, the fastener 58 is sized and configured to be positioned in and at least partially pass through the aperture 46. The fastener 58 can be almost any kind of mechanical device known to those skilled in the art. For example, the fastener 58 can be a nail, a nail having a plurality of slits, grooves, or threads to facilitate its ability to enter into cured concrete, a screw, a bolt, a rivet, a stud, etc.

As best illustrated in FIG. 4, the fastener 58 includes a shank 74 having a pointed end 76 and an opposite end 78 containing an enlarged head 80. The shank 74 extends through the aperture 46 formed in the retainer and shock absorber assembly 40 and into the first aperture 36. The pointed end 76 of the shank 74 is initially encased in the sealant 38. This is the position of the fastener 58 as the bracket assembly 10 is placed on the concrete footing. When the pointed end 76 of the shank 74 is embedded in the sealant 38, one does not have to worry that the pointed end 76 can scratch or cut the skin of a construction worker. It is a safety feature to initially embed the pointed end 76 in the sealant 38. Alternatively, one could insert the fastener 58 after the bracket assembly 10 has been positioned on the concrete footing. Once the fastener 58 is driven down into the aperture 46 beyond the position of the pair of oppositely aligned fingers 52 and 54, the fastener 58 will be unable to be withdrawn.

Desirably, the diameter of the aperture 46 is smaller in dimension than the diameter of the shank 74. Likewise, the outer periphery of the aperture 46 can be smaller than the outer periphery of the shank 74. Typically, the shank 74 will have a cylindrical shape with a circular cross-section. The diameter of the shank 74 will be larger than the diameter of the aperture 46 to create an interference fit. This interference fit will assure that the fastener 58 is aligned perpendicular to the concrete footing into which it will be hammered or driven, such as by a nail gun. The interference fit will also assist in retaining the fastener 58 to the bracket assembly 10.

The enlarged head 80 on the fastener 58 allows a construction worker to strike the fastener 58 with a hammer or with a power gun and drive or move the fastener 58 down through the sealant 38 and completely through the first aperture 36 and into a concrete footing. However, fasteners 58 without enlarged heads 80 can also be utilized. As the fastener 58 passes through the sealant 38, it will displace some of the sealant 38 and force it to extend downward and/or outward across a major portion of the width w of the base member 12. Ideally, the sealant 38 will be spread across the entire width w of the base member 12. This action, along with the excess sealant 38 that is present below the lower surface 24 of the base member 12, will create a moisture proof, watertight, waterproof or water repellant seal between the lower surface 24 of the base member 12 and the upper surface of the concrete footing. By "moisture proof" it is meant that the bracket assembly 10 is secured to the concrete footing such that moisture cannot enter or escape under the lower surface 24 of the base member 12. By "watertight" it is meant that the bracket assembly 10 is secured to the concrete footing such that water cannot enter or escape under the lower surface 24 of the base member 12. By "waterproof" it is meant that the bracket assembly 10 is secured to the concrete footing such that water cannot penetrate under the lower surface 24 of the base member 12.

The sealant 38 is made of or treated with rubber, plastic, a polymer or a sealing agent to resist water penetration, or to be water repellant. By "water repellant" it is meant that the bracket assembly 10 is secured to the concrete footing such that it is resistant to water but not entirely waterproof. The fastener 58 will also permanently secure the bracket assembly 10 to the concrete footing. The bracket assembly 10 is not designed to be removed once it is attached to the concrete footing unless it is incorrectly positioned.

Optionally, the adhesive 48 can be positioned between a lower surface of the shock absorber 72 and the upper surface 22 of the base member 12 to hold the shock absorber 72 secure to the bracket assembly 10. When the adhesive 48 is present, one can feel secure in the fact that the fastener 58 will be joined to the bracket assembly 10. This will ensure that the fastener 58 is not separated from the bracket assembly 10. One of the clear benefits of the bracket assembly 10 is that it is a unitary device that does not require additional elements or items to be attached or to be joined to it. At the construction site, the construction worker simply has to place or position the bracket assembly 10 onto the upper surface of the cured concrete footing and secure it in its proper alignment by hammering or driving the fastener 58 into the concrete footing. Each of the bracket assemblies 10 will remain in place and it is not necessary to remove any of the bracket assemblies 10 after the concrete foundation wall is poured and cured.

The shock absorber 72 functions to permit the fastener 58, i.e. a nail, screw, etc. to be driven through both the first aperture 36 and the sealant 38 and into the concrete footing by a hammer, nail gun, etc. to secure the bracket assembly 10 thereto. As the fastener 58 is driven down into the concrete footing, the enlarged head 80 on the fastener 58 will contact the shock absorber 72. The shock absorber 72 can flex and contract while providing resistant which prevents the fastener 58 from being driven further downward by an appreciable amount. In short, the shock absorber 72 will prevent the base member 12 from breaking or cracking as the fastener 58 is inserted into the concrete footing. As the fastener 58 passes through the sealant 38, it will displace some of the sealant 38 and cause it to move downward and/or outward. This helps assure that a good water tight seal is created between the lower surface 24 of the base member 12 and the upper surface of the cured concrete footing.

Figure 7:
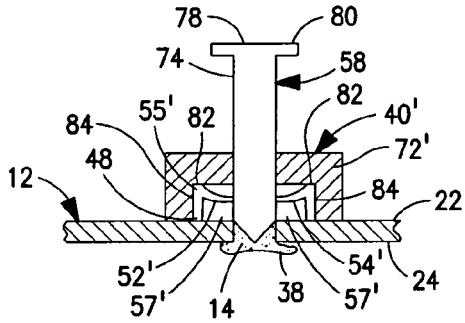
FIG. 7 is an alternative embodiment of the retainer and shock absorber assembly depicting a pair of oppositely aligned fingers encased in a compressible material.

Referring now to FIG. 7, an alternative embodiment for the retainer and shock absorber assembly 40' is shown. In this embodiment, the retainer and shock absorber assembly 40' has a pair of inwardly extending fingers 52' and 54' each having a first end 56 and a second end 82. The first ends 56, 56 are sized and configured to engage with the shank 74 of a fastener 58 as was described above in reference to FIGS. 1-3. The second ends 82, 82 are secured to the cylindrical base member 55', for example to an interior surface of the cylindrical base member 55'. The cylindrical base member 55' has an outer periphery 84 which is completely surrounded by the shock absorber 72'. In other words, the shock absorber 72' portion of the retainer and shock absorber assembly 40' surrounds 360 degrees of the cylindrical base member 55', as well as the upper portion of the cylindrical base member 55'. This is different from FIG. 4, wherein the shock absorber 72 was only positioned above the pair of fingers 52 and 54. Like FIG. 4, a void area 57' is located within the cylindrical base member 55' and is present below each of the pair of fingers 52' and 54'. Desirably, the entire area within the periphery of the cylindrical base member 55' and below the plane of the pair of fingers 52' and 54' is void of shock absorber material. This void area 57' allows the pair of fingers 52' and 54' to flex downward.

Figure 8:
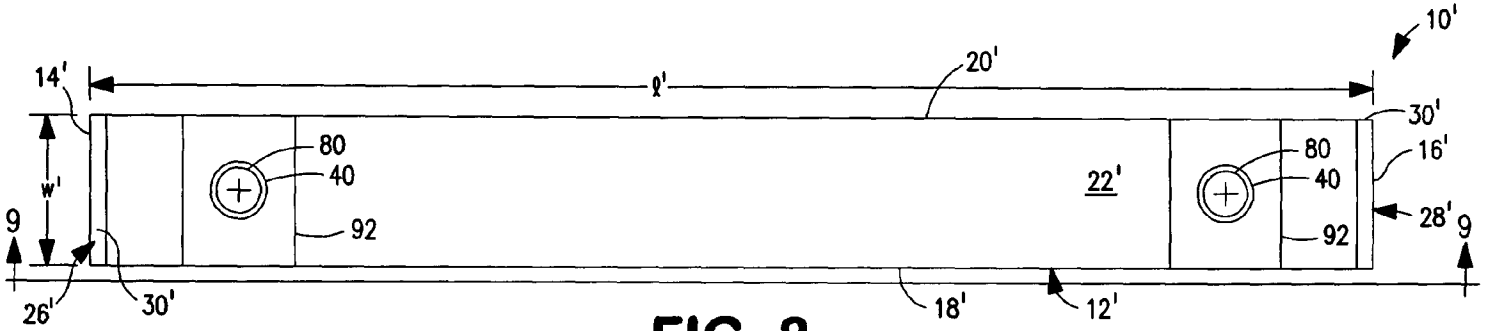
FIG. 8 is a top view of an alternative embodiment of a bracket assembly.
Figure 9:
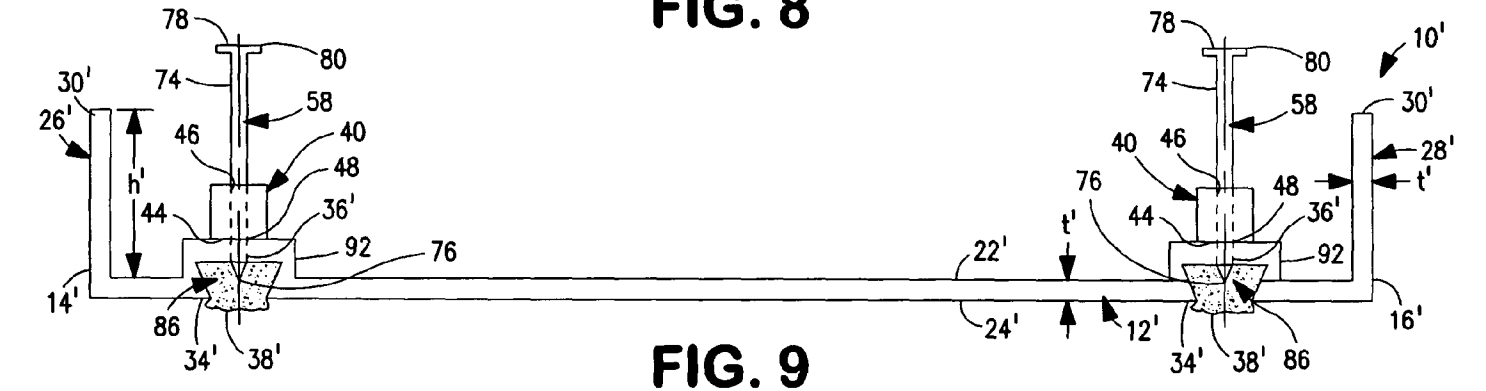
FIG. 9 is a side view of the bracket assembly shown in FIG. 8 taken along line 9-9.
Figure 10:
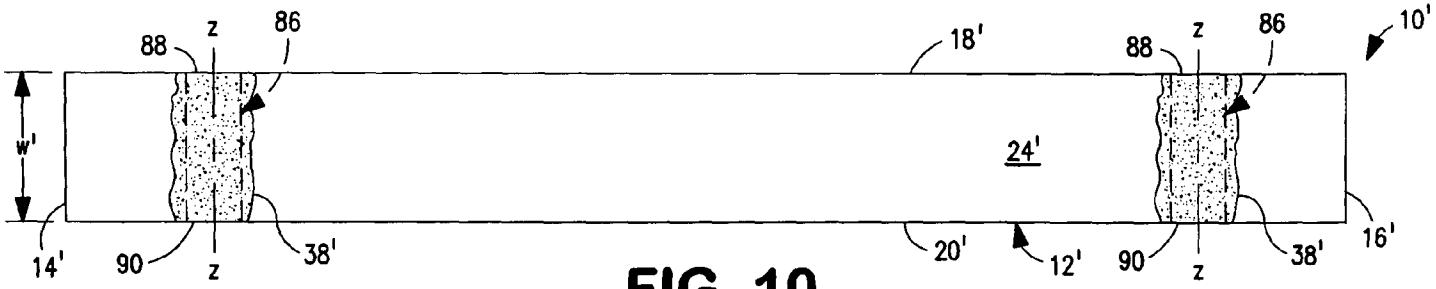
FIG. 10 is a bottom view of the bracket assembly shown in FIG. 8 depicting the sealant positioned in a pair of channels and extending across the width of the bracket.

Referring now to FIGS. 8-10, another embodiment of a bracket assembly 10' is shown for facilitating the installation of a concrete wall on a concrete footing. The bracket assembly 10' includes a base member 12' having a first end 14', a second end 16', a first side edge 18', a second side edge 20', an upper surface 22' and a lower surface 24'. Desirably, the lower surface 24' is planar. The bracket assembly 10' has a length l', a width w' and a thickness t'. The length l', the width w' and the thickness t' can vary in dimension depending upon the material from which it is constructed and the process used to form the bracket assembly 10'. The bracket assembly 10' also includes a first flange 26' and a second flange 28'. The first and second flanges, 26' and 28' respectively, are spaced apart from one another with the first flange 26' being located adjacent to or abutting the first end 14' and the second flange 28' being located adjacent to or abutting the second end 16'. The first and second flanges, 26' and 28' respectively, are aligned approximately at a right angle or 90 degrees to the base member 12'. In other words, the first and second flanges, 26' and 28' respectively, are aligned approximately perpendicular to the base member 12'. Desirably, the first and second flanges, 26' and 28' respectively, are integrally formed with the base member 12' and extend upwardly therefrom. By forming the bracket assembly 10' as an integral unit, one can decrease the cost of manufacturing the bracket assembly 10' since the first and second flanges, 26' and 28' respectively, do not have to be adhered, glued, joined, screwed, bolted or somehow mechanically or chemically joined to the base member 12'.

Referring to FIG. 9, one can clearly see that the bracket assembly 10' has a C-shaped or U-shaped configuration. However, other configurations can also be utilized. Desirably, the first and second flanges, 26' and 28' respectively, will square off the first and second ends, 14' and 16' of the base member 12' and give the bracket assembly 10' the appearance of half of a rectangle. In FIG. 9, one will also see that each of the first and second flanges, 26' and 28' respectively, has a height h'. The height h' is measured from the upper surface 22' of the base member 12', adjacent each flange 26' or 28', to a free or terminal end 30', 30'. The height h' of the first and second flanges, 26' and 28' respectively, can vary to suit one's particular needs and requirements. However, it has been found that the height h' of the first and second flanges, 26' and 28' respectively, should range from between about 0.5 inches to about 3 inches. Desirably, the height h' of the first and second flanges, 26' and 28' respectively, should range from between about 0.6 inches to about 2.5 inches. More desirably, the height h' of the first and second flanges, 26' and 28' respectively, should range from between 0.7 inches to about 2.25 inches. Even more desirably, a height h' for the first and second flanges, 26' and 28' respectively, of between about 0.75 inches to about 2 inches works well for most residential construction of concrete foundation walls.

Referring now to FIGS. 9 and 10, the bracket assembly 10' differs from the embodiment shown in FIGS. 1-3, in that it has a pair of cavities 32', 32' formed in the base member 12'. The pair of cavities 32', 32' is spaced apart from one another. Each of the pair of cavities 32', 32' is formed or configured as a channel 86 having a central axis z—z, see FIG. 10. Each of the channels 86, 86 can be a long, narrow cavity of various cross-sectional configurations. In FIG. 9, each of the channels 86, 86 has a trapezoidal configuration. By "trapezoidal" it is meant a quadrilateral having two parallel sides. However, it is to be understood that each of the channels 86, 86 can have any desired cross-sectional configuration including, but not limited to: square, rectangular, triangular, circular, round, oval, elliptical, or any other geometrical shape known to those skilled in the art. Each of the channels 86, 86 has a first end 88 and a second end 90. Each of the channels 86, 86 spans or bridges across the entire width w' of the bracket assembly 10' such that the first end 88 is located on one side of the base member 12' and the second end 90 is located on the opposite side of the base member 12'. The central axis z—z of each of the channels 86, 86 is aligned approximately parallel or 180 degrees to the first and second flanges, 26' and 28' respectively. Desirably, each of the channels 86, 86 is aligned parallel to the first and second flanges, 26' and 28' respectively.

Each of the pair of channels 86, 86 is located adjacent to and inward of one of the first and second flanges, 26' and 28' respectively. The central axis z—z of each of the channels 86, 86 should be spaced at least about 0.5 inches away from the adjacent flange 26' or 28'. This clearance is needed to provide sufficient room for a construction worker to drive a fastener 58 down through the respective channels 86, 86 when the bracket assembly 10' is being secured to an upper surface of a concrete footing. It is also desirable to have at least 3 inches of clearance, measured along the length l' of the bracket assembly 10', between each of the channels 86, 86. Furthermore, each of the pair of channels 86, 86 has an opening 34' aligned with the lower surface 24' of the base member 12'. In FIG. 9, each of the openings 34', 34' is narrower than the remainder of the respective channel 86. This is another difference from the embodiment shown in FIGS. 1-3. Desirably, each of the openings 34' have a minimum dimension, measured parallel to the length l' of the bracket assembly 10', of at least 0.1 inches, and more desirably, of at least 0.2 inches. This size dimension will help ensure that the sealant 38, positioned in the channels 86, 86 can form an effective seal beneath the lower surface 24' of the bracket assembly 10' and an upper surface of the concrete footing.

Still referring to FIGS. 9 and 10, the bracket assembly 10' further includes a pair of apertures 36', 36' each aligned with one of the channels 86, 86. Each of the pair of apertures 36', 36' extends from the upper surface 22' of the base member 12' down into the cavities 32', 32'. Desirably, each of the apertures 36', 36' is equally spaced across the width w' of the bracket assembly 10' between the first and second ends, 88 and 90 respectively, of each of the channels 86, 86. The length of each of the apertures 36', 36' will partly depend upon the thickness of the base member 12'.

A sealant 38', as described above, is position in each of the pair of channels 86, 86. Desirably, some of the sealant 38' will extend downward a slight amount below the lower surface 24' of the base member 12'. Each of the channels 86, 86 extends completely across the width w' of the bracket assembly 10', and therefore the sealant 38' will also extend completely across the width w' of the bracket assembly 10'. The sealant 38' can initially extend below the lower surface 24' of the base member 12' by from between about 0.01 to about 0.25 inches. Since the upper surface of a cured concrete footing can be rather rough or coarse, the extra sealant 38' present below the lower surface 24' of the bracket assembly 10' will assure that a good seal is formed when the bracket assembly 10' is secured to the concrete footing.

Referring again to FIGS. 8 and 9, the bracket assembly 10' further includes a pair of fasteners 58, 58 each sized and configured to be positioned in and at least partially pass through one of the apertures 46, 46 and initially have its pointed end 76 embedded in the sealant 38'. Each of the pair of fasteners 58, 58 can be constructed as described above with reference to the embodiment shown in FIGS. 1-3. Each of the pair of fasteners 58, as shown in FIG. 9, has a shank 74 with a pointed end 76 and an opposite end 78. Each of the pair of fasteners 58, 58 has an enlarged head 80 at its upper or opposite end 78. Each of the pair of fasteners 58, 58 can be movably retained in one of the apertures 46, 46 such that the respective fastener 58 can only be driven or hammered downwardly into the bracket assembly 10'. The shank 74 of each of the pair of fasteners 58, 58 can form an interference fit with the aperture 46. A retainer and shock absorber assembly 40 or 40' is also present. Each retainer and shock absorber assembly 40 or 40' is secured to the upper surface 22 of the base member 12' by an adhesive 48. A sealant 38' is positioned in each of the pair of channels 86, 86 and serves the same purpose as described above with reference to FIGS. 1-3.

The diameter or cross-section of each of the first apertures 36', 36' can be slightly less than the diameter or cross-section of the shank 74 of each of the pair of fasteners 58, 58. This size difference can create an interference fit between each fastener 58 and corresponding aperture 46. The interference fit helps hold each of the fasteners 58, 58 in the pair of first apertures 36', 36'. However, an interference fit is not required. When an interference fit is present, it will not prevent the pair of fasteners 58, 58 from being driven or hammered down through one of the first apertures 36', 36'. The enlarged head 80 allows a construction worker to strike each of the pair of fasteners 58, 58 with a hammer or power gun and drive or move it down through the respective first aperture 36', through the sealant 38' and into a concrete footing. As each of the fasteners 58, 58 passes through the sealant 38', it will displace some of the sealant 38'. This action, along with the excess sealant 38' that is present, will create a moisture proof, watertight, waterproof or water repellant seal between the lower surface 24' of the bracket assembly 10' and the upper surface of the concrete footing. The pair of fasteners 58, 58 will also permanently secure the bracket assembly 10' to the concrete footing. The bracket assembly 10' is not designed to be removed once it is attached to the concrete footing unless it is incorrectly positioned.

Still referring to FIGS. 9 and 10, the bracket assembly 10' is also depicted as having a pair of retainers and shock absorber assemblies 40, 40. Each of the pair of retainers and shock absorber assemblies 40, 40 can be formed as described above. Each of the pair of retainers and shock absorber assemblies 40, 40 is shown having an aperture 46, 46 sized to permit a portion of one of the fasteners 58, 58 to pass therethrough. A slight interference fit between each of the fasteners 58, 58 and the apertures 46, 46 is beneficial in keeping each of the retainers and shock absorber assemblies 40, 40 attached to its respective fastener 58, 58. Each of the retainers and shock absorber assemblies 40, 40 can also be constructed such that it only partially surrounds a portion of one of the fasteners 58, 58. In FIG. 9, each of the retainers and shock absorber assemblies 40, 40 is depicted as a member situated above and secured to an upwardly extending bulge 92 formed in the upper surface 22' of the base member 12'. As explained above, each of the retainers and shock absorber assemblies 40, 40 can also be formed in a variety of other geometrical shapes, if desired.

Optionally, an adhesive 48 can be positioned between a lower surface 44 of each of the retainers and shock absorber assemblies 40, 40 and the upper surface 22' of the base member 12' to hold each of the retainer and shock absorber assemblies 40, 40' secure to the bracket 12'. When the adhesive 48 is present along with an interference fit between each of the pair of fasteners 58, 58 and its respective first apertures 46, 46, one can feel secure in the fact that each of the pair of fasteners 58, 58 will be joined to the bracket assembly 10'. This will ensure that each of the pair of fasteners 58, 58 is not separated from the bracket assembly 10'. One of the clear benefits of the bracket assembly 10' is that it is a unitary device that does not require additional elements or items to be attached or to be joined to it. At the construction site, the construction worker simply has to place or position the bracket assembly 10' onto the upper surface of the cured concrete footing and secure it in its proper alignment by hammering or driving each of the fasteners 58, 58 into the concrete footing. Each of the bracket assemblies 10' will remain in place and it is not necessary to remove any of the bracket assemblies 10' after the concrete foundation wall is poured and allowed to cure.

The pair of retainers and shock absorber assemblies 40,40 functions to permit the pair of fasteners 58, 58, i.e. nails, screws, etc. to be driven through both of the respective first aperture 36', 36' and the respective sealant 38' and into the concrete footing by a hammer, nail gun, etc. to secure the bracket assembly 10' thereto. As each of the pair of fasteners 58, 58 is driven down into the concrete footing, the enlarged head 80 on each of the fasteners 58 will contact the respective retainer and shock absorber assemblies 40, 40. Each retainer and shock absorber assembly 40 can flex and contract while providing resistant which prevents the respective fastener 58 from being driven further downward by an appreciable amount. In short, each of the retainers and shock absorber assemblies 40, 40 will prevent the base member 12' from breaking or cracking as the respective fasteners 58, 58 are inserted into the concrete footing. As each of the pair of fasteners 58, 58 passes through the respective sealant 38', it will displace some of the sealant 38' and cause it to move downward and outward. This helps assure that a good moisture tight and/or water tight seal is created between the lower surface 24' of the bracket assembly 10' and the upper surface of the cured concrete footing.

Figure 11:
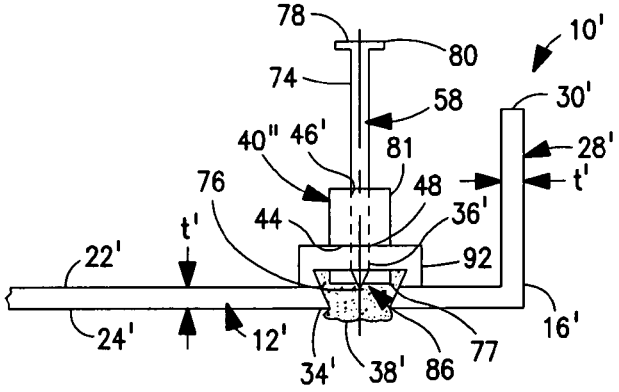
FIG. 11 is a partial view of the bracket assembly shown in FIG. 9 with an alternative retainer and shock absorber assembly.
Figure 12:
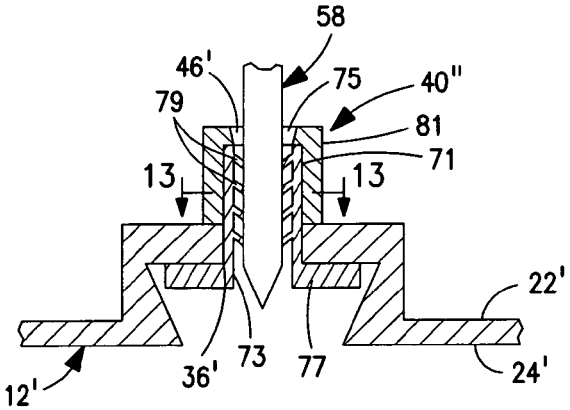
FIG. 12 is an enlarged view of the retainer and shock absorber assembly shown in FIG. 11 without the sealant.
Figure 13:
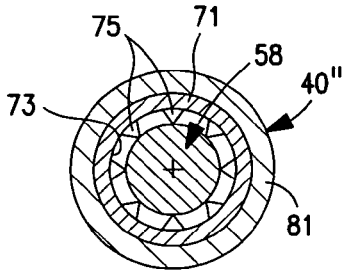
FIG. 13 is a cross-sectional view of the retainer and shock absorber assembly shown in FIG. 11 taken along line 13-13.

Referring now to FIGS. 11-13, an alternative retainer and shock absorber assembly 40" is shown secured to the bracket assembly 10', depicted in FIG. 9. The retainer and shock absorber assembly 40" includes a hollow sleeve 71 having an interior surface 73. The size and shape of the hollow sleeve 71 and the interior surface 73 can vary. Desirably, the hollow sleeve 71 has a cylindrical exterior shape and the interior surface 73 is circular or round in cross-section. The retainer and shock absorber assembly 40" is designed to be positioned adjacent to the lower surface 24' of the bracket assembly 10' with the hollow sleeve 71 extending upward through the first aperture 36' and into the aperture 46'.

A plurality of fingers 75 are formed integral with or are secured to the interior surface 73 of the hollow sleeve 71. Each of the plurality of fingers 75 can be spaced at an equal distance apart from one another around the inner periphery of the interior surface 73 or they can be randomly arranged. The plurality of fingers 75 can be arranged in two or more vertically spaced apart circles or rings within the interior surface 73. The plurality of fingers 75 can also be aligned with one another or be offset from one another in either the horizontal or vertical planes. Likewise, the plurality of fingers 75 can be arranged in various geometrical patterns, including but not limited to: a spiral configuration, a circular configuration, a stepped configuration, a staggered configuration, a random configuration, a regular configuration, a configuration including multiple rows or circles of fingers 75, etc.

Secured to one end of the hollow sleeve 71 is a flange 77. The flange 77 can vary in geometrical size and shape but desirably has a round or square cross-sectional configuration. The width of the flange 77 can be equal to or be greater than about 1.25 times the width or diameter of the hollow sleeve 71. Desirably, the width of the flange 77 is at least about 1.5 times the width of the hollow sleeve 71. More desirably, the width of the flange 77 is at least two times the width of the hollow sleeve 71. It is the flange 77 that will contact the lower surface 24' of the bracket assembly 10' when the retainer and shock absorber assembly 40" is secured to the bracket assembly 10'. The flange 77 secures the retainer and shock absorber assembly 40" to the bracket assembly 10'.

The hollow sleeve 71 is designed to be inserted through the first aperture 36', formed in the base member 12', and extend into the aperture 46' which is formed in the retainer and shock absorber assembly 40". The hollow sleeve 71 can form a loose fit, a snug fit or an interference fit with either of the first aperture 36' and/or with the aperture 46'. Desirably, the hollow sleeve 71 will form a snug fit with both of the apertures 36' and 46'.

Referring now to FIGS. 12 and 13, the plurality of fingers 75 is arranged to point or tilt downward toward the flange 77 and inward toward the center of the interior surface 73 when the hollow sleeve 71 is positioned in the apertures 36' and 46'. The actual number of fingers 75 can vary. There can be an odd number of fingers 75 or an even number of fingers 75. Desirably, the number of fingers 75 will equal or exceed eight. For example, eight fingers can be arranged in a circle, with each spaced 40° apart from one another, see FIG. 13. More desirably, the number of fingers 75 will equal or exceed 16. Even more desirably, the number of fingers 75 will equal or exceed 24. The size and shape of the plurality of fingers 75 can vary. Each of the plurality of fingers 75 can be of the same size as the remaining fingers 75 or at least one of the fingers 75 can vary in size from another finger 75. Typically, all of the fingers 75 are of the same size. Likewise, each of the plurality of fingers 75 can be of the same shape as the remaining fingers 75 or at least one of the fingers 75 can vary in shape from another finger 75. Typically, all of the fingers 75 are of the same shape.

Referring again to FIG. 12, one can see that the plurality of fingers 75 are arranged as five vertical, spaced apart rings 79. The actual number of rings 79 can vary from one ring 79 to ten or more rings 79. Each ring 79 is spaced apart from an adjacent ring 79 by a predetermined distance. The exact distance between adjacent rings 79 can be the same or can vary. Usually, the rings 79 are spaced apart by at least about 0.1 inches. The fastener 58 is sized and designed to pass down through the interior surface 73 of the hollow sleeve 71 and physically contact the plurality of fingers 75. The plurality of fingers 75 will prevent the fastener 58 from being withdrawn from the retainer and shock absorber assembly 40". However, the plurality of fingers 75 will allow the fastener 58 to be hammered or driven downward pass the plurality of fingers 75 and through the sealant 38' into the concrete footing 94.

The retainer and shock absorber assembly 40" also includes a shock absorber 81 formed from a compressible material. The shock absorber 81 can be positioned around at least a portion of the hollow sleeve 71. Desirably, the shock absorber 81 will surround that portion of the hollow sleeve 71 that extends above the upper surface 22' of the bracket assembly 10'. The shock absorber 81 serves the same function as the shock absorber 72 explained above.

Figure 14:
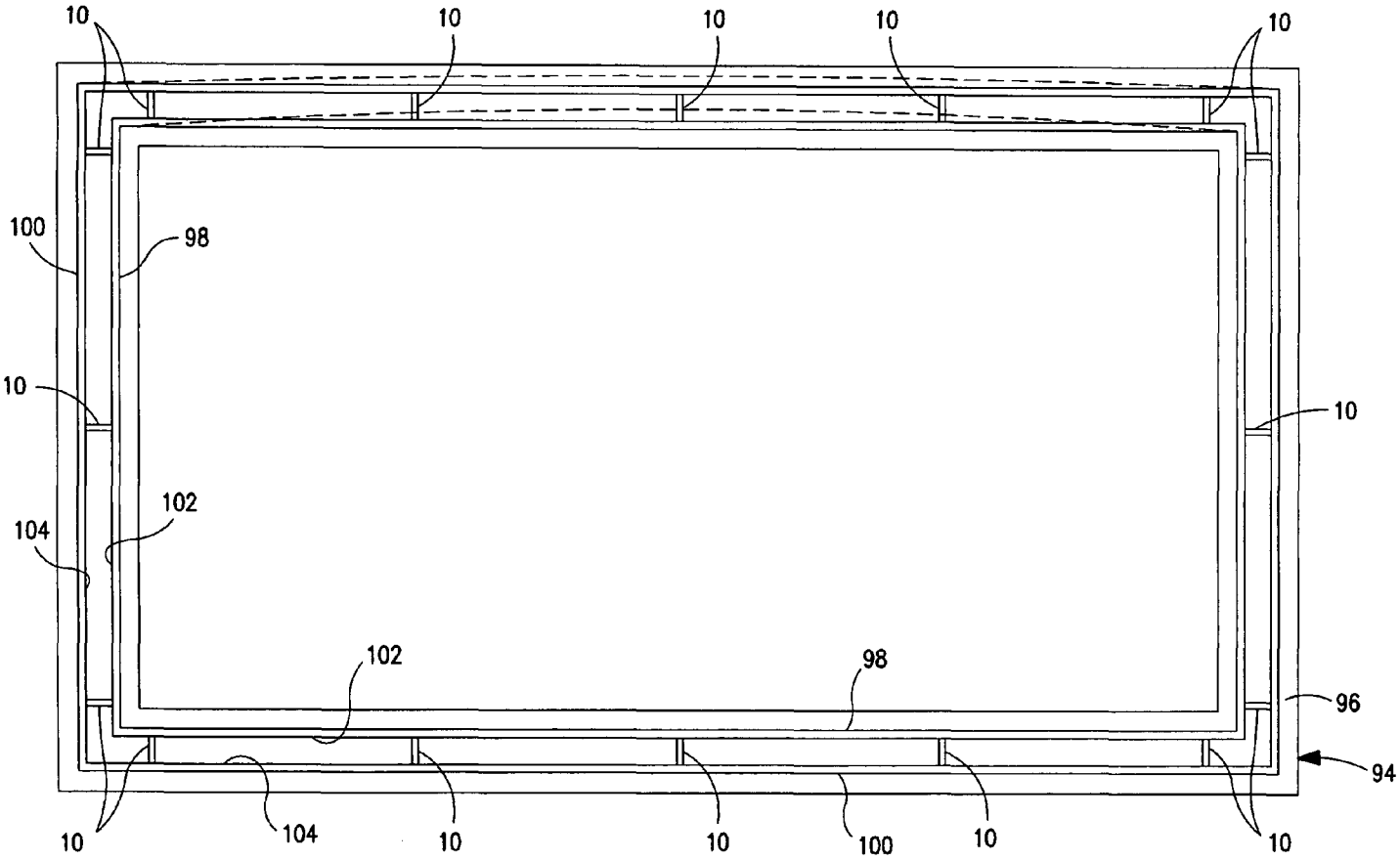
FIG. 14 is a plan view of interior and exterior foundation wall forms positioned on a concrete footing and spaced a set distance apart by a plurality of bracket assemblies.

Referring now to FIG. 14, a plan view of a rectangular shaped concrete footing 94 is shown having an upper surface 96. The concrete footing 94 is at least partially cured or hardened so that it can support weight, such as a foundation wall. Secured to the upper surface 96 of the concrete footing 94 is a plurality of the bracket assemblies 10 or 10'. The bracket assemblies 10 or 10' are spaced a predetermined distance apart over the perimeter of the concrete footing 94. Normally, a bracket assembly 10 or 10' can be placed about 1.5 feet, 2 feet, 3 feet or any desired distance from an adjacent bracket assembly 10 or 10'. At the corners of the concrete footing 94 or at a bend, at a curved portion, at a shoulder, etc., the bracket assemblies 10 or 10' can be spaced closer together to provide additional support. For example, at each corner of the concrete footing 94, the adjacent bracket assemblies 10 or 10' may be spaced only a few inches apart.

Still referring to FIG. 14, an interior foundation wall form 98 and an exterior foundation wall form 100 are shown being positioned on the upper surface 96 of the concrete footing 94 adjacent to the upstanding first and second flanges 26 and 28 or 26' and 28' of each bracket assemblies 10 or 10'. The interior and exterior foundation wall forms, 98 and 100 respectively, abut against the outside surfaces of the flanges 26 and 28 or 26' and 28' and are aligned parallel to one another. The bracket assemblies 10 or 10' keep and retain the interior and exterior foundation wall forms, 98 and 100 respectively, in a parallel alignment and at a set distance apart. The bracket assemblies 10 or 10' prevent the interior and exterior foundation wall forms, 98 and 100 respectively, from becoming misaligned, as indicated by the dotted lines in the upper portion of FIG. 14.

The interior foundation wall form 98 has a smooth inner surface 102 and the exterior foundation wall form 100 has a smooth inner surface 104. The two smooth inner surfaces, 102 and 104, face one another when the interior and exterior foundation wall forms, 98 and 100 respectively, are correctly positioned on the upper surface 96 of the concrete footing 94. The interior and exterior foundation wall forms, 98 and 100 respectively, are commonly constructed of aluminum, steel, metal, wood or a combination of two or more different materials. The interior and exterior foundation wall forms, 98 and 100 respectively, can be obtained in a variety of sizes, such as: 1 foot by 8 feet, 2 feet by 8 feet, 4 feet by 8 feet, etc. or in smaller sizes such as 1 foot by 2 feet, 2 feet by 4 feet, 4 feet by 4 feet, etc. The interior and exterior foundation wall forms, 98 and 100 respectively, can also be obtained in various shapes to extend around corners, to form an arc, a semi-circle, a rounded or circular shape, or to form some other geometrical profile. For example, the interior and exterior foundation wall forms, 98 and 100 respectively, can be L-shaped, C-shaped, U-shaped, etc.

Figure 15:
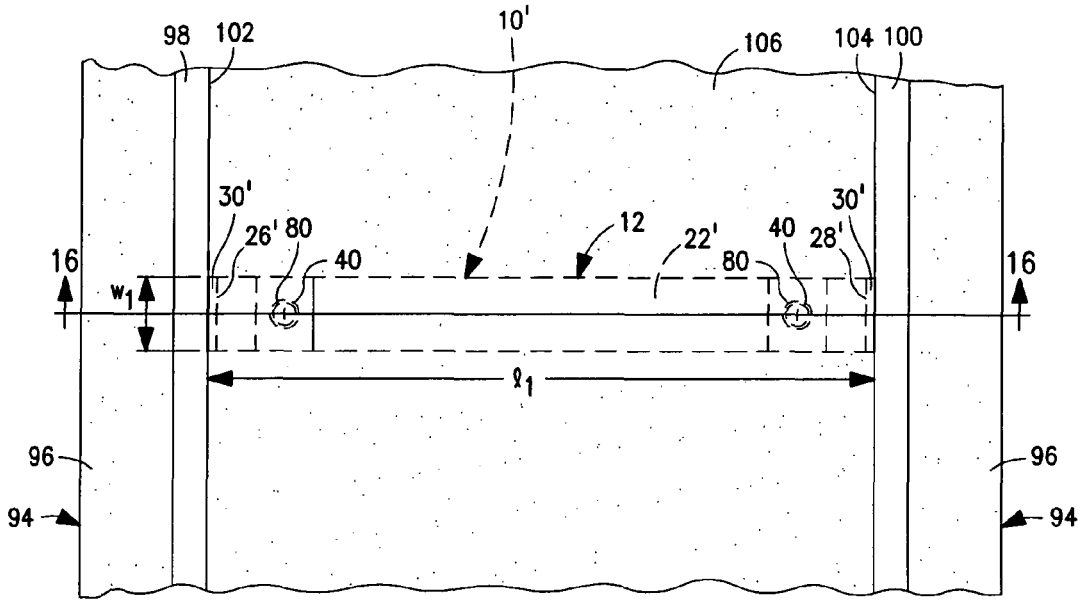
FIG. 15 is a top view of a concrete foundation wall set between an interior foundation wall form and an exterior foundation wall form which are separated by a bracket assembly and the foundation wall is formed on the upper surface of a concrete footing.
Figure 16:
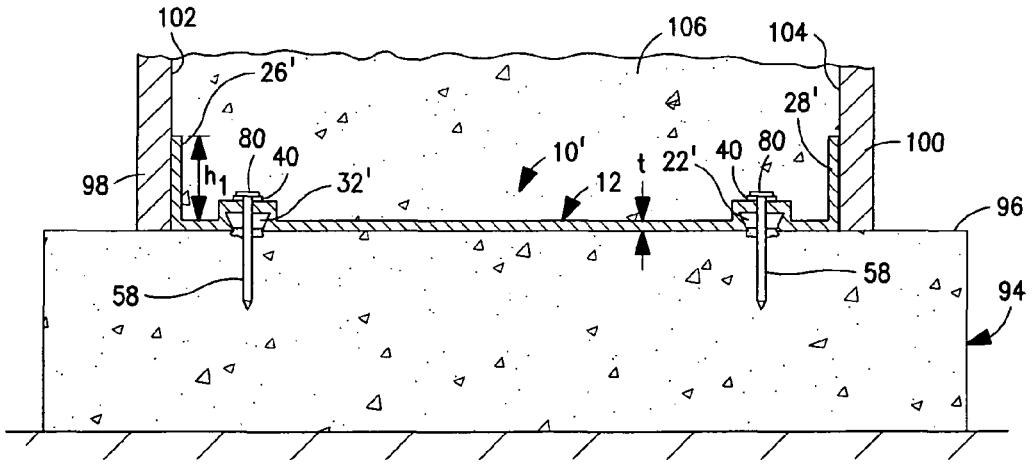
FIG. 16 is an elevation cross-sectional view of the various elements shown in FIG. 15 taken along line 16-16

Turning now to FIGS. 15 and 16, one can clearly see that the interior and exterior foundation wall forms, 98 and 100 respectively, are not secured, joined or attached to the first and second flanges 26' and 28' but instead abut such flanges 26' and 28'. When properly assembled, the bracket assemblies 10 or 10' are positioned between the inner surfaces 102 and 104 of the interior and exterior foundation wall forms, 98 and 100 respectively. The bracket assemblies 10 or 10' are permanently attached or secure to the concrete footing 94 by the fasteners 58, 58 and are designed to stay in place after the foundation wall is poured. The bracket assemblies 10 or 10' prevent the interior and exterior foundation wall forms, 98 and 100 respectively, from moving laterally with respect to the concrete footing 94. Concrete is then poured between the smooth inner surfaces 98 and 100 of the interior and exterior foundation wall forms, 98 and 100 respectively. The concrete is allowed to cure or set over a number of days to form a concrete foundation wall 106. The curing time is dependent on: the composition of the concrete mix, the length, width and depth of the concrete, the outside temperature, the relative humidity, the climate, and any chemicals added to the concrete mix, as well as other factors known to those skilled in the art.

Once the concrete foundation wall 106 has at least temporarily cured, the interior and exterior foundation wall forms, 98 and 100 respectively, are removed. The interior and exterior foundation wall forms, 98 and 100 respectively can be reused multiple times on various buildings. With the bracket assemblies 10 or 10' in place between the upper surface 96 of the concrete footing 94 and a lower surface of the foundation wall 106, a seal will be formed by the sealant 38. The sealant 38 will prevent moisture and/or water from flowing along the lower surface, 24 or 24', of the bracket assembly, 10 or 10' respectively, from outside of the foundation wall 106 to the inside of the foundation wall 106.

Method

Referring now to FIG. 17, a flow chat is depicted of a method for facilitating the installation of a concrete wall on a concrete footing. The method includes the steps of marking a pair of spaced apart, parallel lines on the upper surface 96 of a concrete footing 94. The set of parallel lines can be formed by using a string encased in a powered, colored chalk. The string can be stretched to a taut position directly above and in close proximity to the upper surface 96 of the concrete footing 94. The string is then pulled upward and released so that it will snap against the upper surface 96. This action causes the powered, colored chalk to exit the string and form a line on the concrete footing 94. One or two chalked positioning lines can be formed on the upper surface 96 of the concrete footing 94. When one positioning line is used, it should be the exterior positioning line. After the one positioning line is marked, one or more bracket assemblies 10 or 10' can be aligned perpendicular to the positioning line and be secured in place by the fastener(s) 58, 58. Optionally, both an interior positioning line and an exterior positioning line are marked on the upper surface 96 of the concrete footing 94. After the two parallel positioning lines are marked, one or more bracket assemblies 10 or 10' are secured to the upper surface 96 of the cured concrete footing 94 by driving the fastener(s) 58, 58 into the concrete footing 94, such as by the use of a hammer or a nail gun. Desirably, multiple bracket assemblies 10 or 10' are used for a single building.

Each of the bracket assemblies 10 or 10' are positioned between the pair of spaced apart lines at a predetermined distance from one another. The distance between each bracket assembly 10 or 10' can vary, especially when one has to contend with corners, bends, jogs, etc. Each of the bracket assemblies 10 or 10' includes a base member 12 or 12' having a first end 14 or 14', a second end 16 or 16', a first side edge 18 or 18', a second side edge 20 or 20', an upper surface 22 or 22' and a lower surface 24 or 24'. Each bracket assembly 10 or 10' also includes first and second spaced apart flanges, 26 and 28 or 26' and 28' respectively, which are integrally formed with the base member 12 or 12'. The first and second flanges, 26 and 28 or 26' and 28' respectively, extend upwardly from the base member 12 or 12'. One or more cavities 32 or 32' are also formed in the base member 12 or 12'. Each of the cavities 32 or 32' has an opening, 34 or 34' respectively, aligned with the lower surface 24 or 24' of the base member 12 or 12'. One or more first apertures 36 are formed through the base member 12 or 12' and each of the first apertures 36, 36 is aligned with one of the cavities 32 or 32'. A sealant 38 is positioned in each of the cavities 32 or 32' and the sealant 38 partially extends outward below the lower surface 24 or 24' of the bracket assembly 10 or 10'. Desirably, the sealant 38 extends across the entire width w or w' of the bracket assembly 10 or 10' in order to form a satisfactory seal. A movable fastener 58 is positioned in each of the first apertures 36.

A retainer and shock absorber assembly 40, 40' or 40" is secured or positioned adjacent to the upper surface 22, 22' or to the lower surfaces 24, 24' of the base member 12 or 12'. An aperture 46 is formed through the retainer and shock absorber assembly 40, 40' or 40". The aperture 46 is coaxially aligned with the first aperture 36. A fastener 58 which includes a shank 74 having a pointed end 76 and an opposite end 78 is positioned in the aperture 46. The opposite or upper end 78 of the fastener 58 has an enlarged head 80 which prevents this end of the fastener 58 from being driven below the upper surface 66 of the retainer and shock absorber assembly 40, 40' or 40". The shank 74 extends through the aperture 46 which is formed in the retainer and shock absorber assembly 40, 40' or 40" and into the first aperture 36. The pointed end 76 of the shank 74 can be initially encased in the sealant 38, if desired. The fastener 58 is inseparable from the retainer and shock absorber assembly 40, 40' or 40" by the pair of fingers 52 and 54, or by the plurality of fingers 75, which engage the shank 74 and prevent it from being withdrawn from the retainer and shock absorber assembly 40, 40' or 40". The pair of fingers 52 and 54 or the plurality of fingers 75 will allow the fastener 58 to be driven or hammered downwardly into the concrete footing 94 but prevent the fastener 58 from being pulled upwardly so as to be withdrawn from the retainer and shock absorber assembly 40, 40' or 40".

Each of the bracket assemblies 10 or 10' is then secured to the upper surface 96 of the concrete footing 58 by driving the fastener(s) 58, 58 through the sealant 38 and into the concrete footing 94. An interior foundation wall form 98 is then positioned adjacent to and outside of the first flange 26 or 26'. An exterior foundation wall form 100 is simultaneously or sequentially positioned adjacent to and outside of the second flange 28 or 28'. Each of the interior and exterior foundation wall forms, 98 and 100 respectively, has a smooth inner surface, 102 and 104 respectively. The interior and exterior foundation wall forms, 98 and 100 respectively, are spaced an even distance apart and are aligned parallel to one another. Additional brackets or mechanical devices can be attached to the lower, middle and/or upper surfaces of the interior and exterior foundation wall forms, 98 and 100 respectively, to maintain the proper spacing therebetween. Commonly, a mechanical device, such as a tie, is positioned about one foot from the bottom of a foundation wall form, a second mechanical device is positioned about one foot from the top of the foundation wall form, and additional mechanical devices are spaced about every two feet therebetween. Concrete is then poured between the interior and exterior foundation wall forms, 98 and 100 respectively, and the concrete is allowed to cure or set to form an upstanding foundation wall 106.

Once the concrete has cured or set, the interior and exterior foundation wall forms, 98 and 100 respectively, are removed. The bracket assemblies 10 or 10' are left in place between the upper surface 96 of the concrete footing 94 and a lower surface of the foundation wall 106. The sealant 38, located on the lower surface 24 or 24' of the brackets assemblies 10 or 10', can be of a moisture and/or water repellant silicone. The silicone functions to prevent moisture and/or water from seeping under the bracket 12 or 12' between the concrete foundation wall 106 and the upper surface 96 of the concrete footing 94. It is important to prevent moisture and/or water from seeping from the outside of the foundation wall 106 to the inside of the foundation wall 106.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A bracket assembly for facilitating installation of a concrete wall on a concrete footing, comprising:

a) a base member having a first end, a second end, a first side edge, a second side edge, an upper surface and a lower surface, a first flange integrally formed with said base member and extending upwardly from said first end, and a second flange integrally formed with said base member and extending upwardly from said second end;

b) a cavity formed in said lower surface of said base member;

c) a first aperture formed through said base member and into said cavity;

d) a sealant positioned in said cavity;

e) a retainer and shock absorber assembly secured to said base member and having an aperture formed therethrough which is coaxially aligned with said first aperture, said retainer and shock absorber assembly having at least two fingers extending into said aperture, each of said fingers having a first end and an oppositely aligned second end, a first side edge, a second side edge, an upper surface and a lower surface, said upper surface having a concave configuration between said first and second side edges, and said first end having a plurality of teeth formed thereon; and f) a fastener including a shank having a pointed end and an opposite end containing an enlarged head, said shank extending through said aperture formed in said retainer and shock absorber assembly and into said first aperture, said plurality of teeth designed to contact a portion of said shank when said shank is inserted into said aperture and passes below said at least two fingers such that said at least two fingers will prevent said shank from being withdrawn from said retainer and shock absorber assembly, and said fastener capable of being driven through said sealant and into said concrete footing to secure said bracket assembly thereto.

2. The bracket assembly of claim 1 wherein said pointed end of said shank is initially encased in said sealant, and is positioned above said upper surface of said base member.

3. The bracket assembly of claim 1 wherein said aperture has an outer periphery and said retainer and shock absorber assembly comprises a pair of oppositely aligned fingers each having a first end which extends within said outer periphery of said aperture, and a shock absorber formed from a compressible material positioned adjacent to said pair of fingers.

4. The bracket assembly of claim 3 wherein said first ends of said pair of fingers engage with said shank of said fastener when said shank is inserted into said first aperture and passes said pair of fingers, said pair of fingers preventing said fastener from being withdrawn from said first aperture.

5. The bracket assembly of claim 1 wherein said retainer and shock absorber assembly comprises an upper surface and a lower surface with said aperture extending therebetween, said aperture having an outer periphery, a pair of oppositely aligned fingers each having a first end which extends within said outer periphery of said aperture, said pair of fingers capable of engaging with said shank when said shank is inserted into said aperture and past said pair of fingers such that said pair of fingers will prevent said shank from being withdrawn therefrom, and a shock absorber formed from a compressible material positioned adjacent to said pair of fingers.

6. The bracket assembly of claim 5 wherein each of said oppositely aligned fingers has a second end aligned opposite to said first end, a first side edge, a second side edge, an upper surface and a lower surface, said upper surface having a non-planar configuration between said first and second side edges.

7. The bracket assembly of claim 1 wherein said shank has an outside diameter and said aperture formed in said retainer and shock absorber assembly has an outside diameter which is smaller than said outside diameter of said shank.

8. The bracket assembly of claim 1 wherein said retainer and shock absorber assembly is secured to said upper surface of said base member by an adhesive.

9. A bracket assembly for facilitating installation of a concrete wall on a concrete footing, comprising:

a) a base member having a first end, a second end, a first side edge, a second side edge, an upper surface and a lower surface, a first flange integrally formed with said base member and extending upwardly from said first end, and a second flange integrally formed with said base member and extending upwardly from said second end;

b) a cavity formed in said lower surface of said base member;

c) a first aperture formed through said base member and into said cavity;

d) a sealant positioned in said cavity;

e) a retainer and shock absorber assembly having an aperture extending therebetween, said aperture having at least two fingers extending into said aperture, and a shock absorber formed from a compressible material positioned adjacent to said fingers, each of said fingers having a first end and an oppositely aligned second end, a first side edge, a second side edge, an upper surface and a lower surface, said upper surface having a concave configuration between said first and second side edges, and said first end having a plurality of teeth formed thereon; and f) a fastener including a shank having a pointed end and an opposite end containing an enlarged head, said shank extending through said aperture formed in said retainer and shock absorber assembly and into said first aperture, said plurality of teeth designed to contact a portion of said shank when said shank is inserted into said aperture and passes below said at least two fingers such that said at least two fingers will prevent said shank from being withdrawn from said retainer and shock absorber assembly, and said fastener capable of being driven through said sealant and into said concrete footing to secure said bracket assembly thereto.

10. The bracket assembly of claim 9 wherein said cavity is formed between said upper surface and said lower surface of said base member, said upper surface is formed on a horizontal plane, and said cavity has an uppermost surface which lies above said horizontal plane of said upper surface.

11. The bracket assembly of claim 9 wherein said cavity is a channel having a trapezoidal configuration which extends between said first and second side edges of said base member, and said channel being aligned parallel to and spaced apart from said first flange.

12. The bracket assembly of claim 9 wherein said sealant is silicone.

13. The bracket assembly of claim 9 wherein said sealing material is a foam.

14. A method of facilitating installation of a concrete wall on a concrete footing, said method comprising the steps of:

a) marking a pair of spaced apart lines on an upper surface of said concrete footing;

b) positioning at least two bracket assemblies between said pair of spaced apart lines at a predetermined distance, each of said bracket assemblies including a base member having a first end, a second end, a first side edge, a second side edge, an upper surface and a lower surface, a first flange integrally formed with said base member and extending upwardly from said first end, and a second flange integrally formed with said base member and extending upwardly from said second end, a cavity formed in said lower surface of said base member, a first aperture formed through said base member and into said cavity, a sealant is positioned in said cavity, a retainer and shock absorber assembly secured to said base member and having an aperture formed therethrough which is coaxially aligned with said first aperture, said retainer and shock absorber assembly having at least two fingers extending into said aperture, each of said fingers having a first end and an oppositely aligned second end, a first side edge, a second side edge, an upper surface and a lower surface, said upper surface having a concave configuration between said first and second side edges, and said first end having a plurality of teeth formed thereon, and a fastener including a shank having a pointed end and an opposite end containing an enlarged head, said shank extending through said aperture formed in said retainer and shock absorber assembly and into said first aperture, said plurality of teeth designed to contact a portion of said shank when said shank is inserted into said aperture and passes below said at least two fingers such that said at least two fingers will prevent said shank from being withdrawn from said retainer and shock absorber assembly, and said fastener being retained to said retainer and shock absorber assembly;

c) securing each of said bracket assemblies to said concrete footing by driving said fastener through said sealant and into said concrete footing;

d) positioning an interior and an exterior wall form adjacent to said first and second flanges; and e) pouring concrete between said interior and exterior wall forms to create a concrete wall.

15. The method of claim 14 further comprising the step of removing said interior and exterior wall forms after said concrete wall has at least partially cured.

16. The method of claim 14 wherein multiple brackets assemblies are secured to said upper surface of said concrete footing at predetermined distances.

17. The method of claim 14 wherein said sealant is a water repellant silicone which functions to prevent water from seeping between said concrete wall and said concrete footing.

18. The method of claim 14 wherein said pair of spaced apart lines formed on said upper surface of said concrete footing are formed using powdered, colored chalk.

* * * * *